US005265775A

United States Patent [19]

Sinclair et al.

[11] Patent Number: 5,265,775

[45] Date of Patent: Nov. 30, 1993

[54] AEROSOL SPRAY CONTAINER

[75] Inventors: Guy M. Sinclair, Leeds; Anthony C. L. Wass, Duddington, both of Great Britain

[73] Assignee: Chesebrough-Pond's USA Co., Division of Conopco, Inc., Greenwich, Conn.

[21] Appl. No.: 866,632

[22] Filed: Apr. 10, 1992

[30] Foreign Application Priority Data

Apr. 11, 1991 [GB] United Kingdom ..... 9107681

[51] Int. Cl.[5] ..... B65D 83/14

[52] U.S. Cl. ..... 222/400.8; 222/401; 222/402.1

[58] Field of Search ..... 222/401, 209, 400.8, 222/402.1

[56] References Cited

U.S. PATENT DOCUMENTS

| | | | |
|---|---|---|---|
| 2,031,172 | 2/1936 | Maloney | 222/401 X |
| 3,132,807 | 5/1964 | Nadai | 222/209 X |
| 4,274,562 | 6/1981 | Medeiros et al. | 222/401 |

FOREIGN PATENT DOCUMENTS

| | | |
|---|---|---|
| 313780 | 3/1974 | Austria . |
| 0238611 | 9/1987 | European Pat. Off. . |
| 0403417 | 12/1990 | European Pat. Off. . |
| 2206743 | 6/1974 | France . |
| 80/01482 | 7/1980 | PCT Int'l Appl. . |
| 299280 | 10/1928 | United Kingdom . |
| 1379346 | 1/1975 | United Kingdom . |
| 1564996 | 4/1980 | United Kingdom . |
| 1582556 | 1/1981 | United Kingdom . |

*Primary Examiner*—Sherman D. Basinger
*Attorney, Agent, or Firm*—Milton L. Honig

[57] ABSTRACT

An aeorsol dispensing apparatus for dispensing a liquid under pressure as an aerosol without the use of a pre-dosed propellant, comprising a container for storing the liquid to be sprayed, spray mechanism, and a mechanism for manually introducing atmospheric air into the apparatus to generate a positive pressure therein, the spray mechanism having a nozzle by which the fluid may be dispensed and a feeder pipe to supply the nozzle with fluid to be sprayed, characterized in that the apparatus additionally comprises an intermediate spacer collar which supports the spray mechanism, and to which the container may be attached.

5 Claims, 3 Drawing Sheets

AEROSOL SPRAY CONTAINER

BACKGROUND OF THE INVENTION

1. Field of the Invention

This invention relates to aerosol dispensers and containers therefor. In particular, it relates to aerosol dispensers which utilize dispensing pumps which do not rely on an added propellant gas.

2. The Related Art

Dispensing pumps are known which can be fitted to dispensing containers, and can be used for dispensing the liquid contents of the containers where the container does not contain any added propellant gas, such as hydrocarbons or chlorofluorocarbons. Instead, the container or the dispensing pump contains a mechanism by which atmospheric air can be introduced into the container to produce a positive pressure, which may be used to provide the required pressure for the liquid to be adequately dispensed in aerosol form.

Such systems are conveniently known as "user pressurised dispensers". An example of such systems is described in GB 1582556 (Airspray), which describes an aerosol dispensing mechanism incorporating a one-way valve and plunger system, which can be used to introduce atmospheric air into a container to which it is attached.

A further development of this aerosol dispensing mechanisms is described in EP 238 611 (Airspray). These aerosol dispensing mechanisms are self-contained units, which conventionally attach to ordinary bottles by means of a simple collar piece, which may be used to attach the aerosol dispensing mechanism to the bottle by simply screwing the collar onto a thread located around the neck of the bottle.

A claimed advantage of such aerosol dispensing mechanisms is that, when they are used on a commercial scale to dispense e.g. hair spray or aerosol deodorants, it is possible to buy the liquid hair spray or deodorant in a so-called "refill" pack. The refill pack can then be used either to decant the liquid product into the original container, or may be attached, via the aforementioned screw-on collar, onto the aerosol dispensing mechanism.

However, it is a recognised characteristic of user pressurised systems, in particular those which utilise the aerosol dispensing mechanism described in EP 238 611 (the so called "dry spray" unit) that the container holding the liquid product to be dispensed must not be completely filled with liquid product. In particular, as far as possible, the liquid product in the container should not come into contact with the aerosol dispensing mechanism during the act of dispensing the product, since such contact nullifies the advantageous effects of using this aerosol dispensing mechanism.

SUMMARY OF THE INVENTION

We have found that this disadvantageous effect, plus other disadvantageous effects, can be overcome by the use of an intermediate "spacer" collar by which the aerosol dispensing mechanism is attached to the container. The intermediate spacer collar conveniently has mechanism by which it may be attached to the aerosol dispensing mechanism. (preferably that described in EP 238 611) and mechanism (e.g. a co-operating screw thread) by which it may be attached to the container. The combined aerosol dispensing mechanism - spacer collar - container, or also just the aerosol dispensing mechanism - spacer collar, may provide a re-usable device.

Preferably, the spacer collar is of such shape and dimensions so as to prevent the aerosol dispensing mechanism in use from being inadvertently immersed in fluid stored in the container, caused by too much fluid being stored in the container.

Thus, according to the invention, there is provided an aerosol dispensing apparatus for dispensing a liquid under pressure as an aerosol without the use of a predosed propellant, comprising a container for storing the liquid to be sprayed, spray mechanism, and a mechanism for manually introducing atmospheric air into the apparatus to generate a positive pressure therein, the spray mechanism having a nozzle by which the fluid may be dispensed and a feeder pipe to supply the nozzle with fluid to be sprayed, characterised in that apparatus additionally comprises an intermediate spacer collar which supports the spray mechanism, and to which the container may be attached.

Preferably the intermediate spaces collar is shaped so as to prevent the spray mechanism from being immersed in any fluid contained in the container.

According to a preferred embodiment of the invention, the mechanism for introducing atmospheric air into the apparatus comprises a co-operating plunger and plunger channel, located adjacent the spray mechanism.

Conveniently the apparatus according to the invention additionally comprises a cap, the cap being integral with the mechanism for manually introducing atmospheric air into the apparatus, such as a plunger.

Conveniently many parts of the apparatus, in particular the intermediate spacer collar and the container, are made of molded plastics materials.

The advantages of using the intermediate spacer collar in conjunction with user pressurized aerosol dispensers having such an aerosol dispensing mechanism and container are severalfold. Firstly, if made from a material such as opaque plastics material, it may be cheaply and easily manufactured, and may be used to shield from the consumer the otherwise unsightly aerosol dispensing mechanism, especially in the process of refilling the container with liquid product to be dispensed. A further advantage of the invention over conventional pressurized aerosols which contain an added propellant gas is that all, or at least part of the aerosol apparatus may be reused, thus providing environmental benefits.

Further, if the combination of aerosol dispenser mechanism and spacer collar is re-used, this may be attached to a container which is purchased pre-packed with the requisite amount of refill liquid. This, therefore, prevents the user from having to decant the product liquid into a re-used container. There may additionally be fewer parts for the user to manipulate when refilling the apparatus.

Additionally, if the refill is purchased as a pre-packed unit, it is possible to provide, as a refill container, a container which is essentially completely filled with liquid. This has advantages in that the refill container can be accurately dosed on a large scale with liquid, and it is also more aesthetic to the consumer to see the refill container essentially full.

This is to be contrasted to the situation if the user is required to decant the product liquid into a re-used container; as previously mentioned, usually the refilled container cannot be completely refilled but must be only partially refilled, thereby providing an outspace in which the aerosol dispensing mechanism is located. It is more convenient for the user to refill the container to the top of a container (i.e. fill it), rather than only partially fill it to a level in the container which may be difficult for the user to accurately judge. On an industrial scale it may also be easier to provide for the complete filling, rather than partial filling, of mass dosed containers.

If the aerosol dispenser system- intermediate spacer collar only is re-used and refills are purchased as prepacked units, the need for the consumer to decant liquids at all is eliminated, hence preventing the mess that can occur in pouring fluid from one container to another. Also prevented is the exposure of the user to the possibly harmful components which commonly occur in aerosol dispensed solutions, for example certain organic solvents.

The use of an intermediate spacer collar also results in a simpler system for the user, since the collar and aerosol dispenser system can be joined together, for example during manufacture, and thereafter need not be separated by the user again during cycles of re-use. Instead, the spacer collar - aerosol dispenser system can simply be transferred as a single unit, in contrast to conventional use of such aerosol dispenser systems which utilize a separate screw-threaded collar which is simply screwed onto the neck of a container.

A further advantage of apparatuses according to the invention may be realised when using the invention to dispense fluids which contain volatile components, such as for example deodorant compositions which contain volatile perfume components. In particular, when these compositions may be stored (for example between manufacture and use) in containers in which there is the minimum possible head space, and hence minimal contact with air, any deterioration or loss of the perfume element may be minimised. Apparatuses according to the invention lend themselves to the storage of such perfumed compositions in ways such that contact of the composition with air is minimised. This is in contrast to prior art dispensers.

It is to be noticed that many of the problems overcome by the invention are peculiar to user pressurized aerosol systems, which dispense an aerosol under a positive pressure. These problems are not encountered using other forms of aerosol spray, such as conventional pressurized aerosol sprays which utilize an added propellant gas.

BRIEF DESCRIPTION OF THE DRAWING

The invention will now be described by way of example only, in which two different embodiments of the invention are shown.

DETAILED DESCRIPTION

Figure 1:
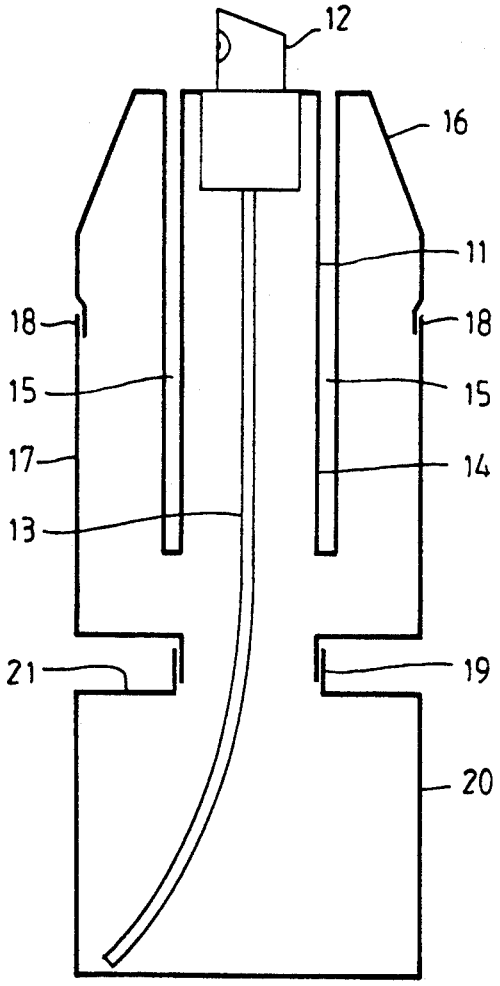
FIG. 1 shows a cross sectional view of an embodiment of the invention.

The embodiment of FIG. 1 comprises a cross-sectional view of an apparatus according to the invention. The apparatus has spray mechanism which comprises an aerosol dispenser mechanism 11, of the type described in EP 238 611, having a nozzle 12, and a feeder pipe 13. The apparatus further has a mechanism for manually introducing atmospheric air into the apparatus to generate a positive pressure therein, which comprises body 14, and plunger channel 15. Plunger channel 15 receives a plunger (not shown), which is manually moved up and down by the user in order to generate the necessary air pressure inside the container for the aerosol dispenser to work. The aerosol dispenser mechanism 11 additionally has an integral shoulder 16. Shoulder 16 is manufactured from rigid plastics material, and is attached to intermediate spacer collar 17 (also made from plastics material), by conventional means at joint 18. Intermediate spacer collar 17 is also joined by a screw thread (not shown) at joint 19 to container 20, which may be used to contain the fluid to be dispensed. As can be readily seen, container 20 can easily be filled to a precise level, for example that of shoulder 21 of container 20.

Figure 2:
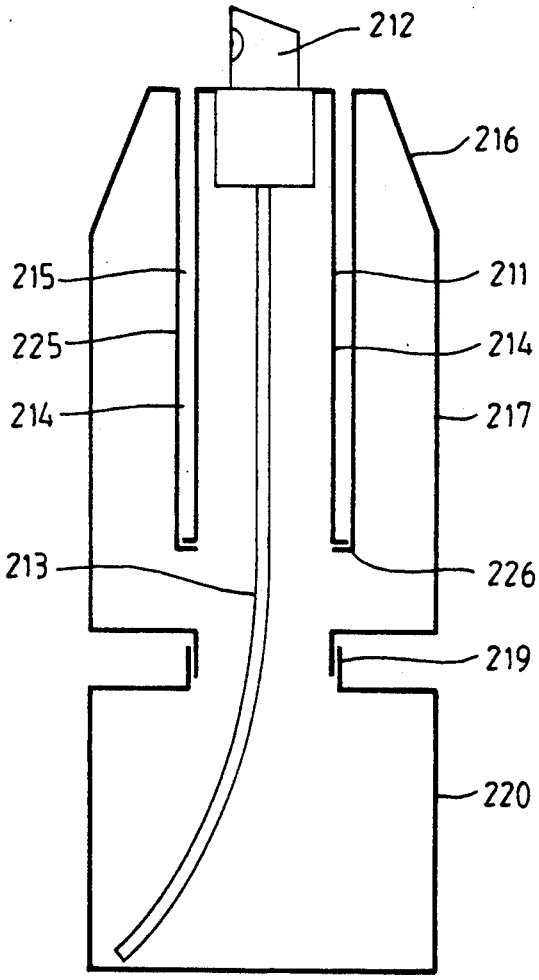
FIG. 2 shows a cross sectional view of further embodiment of the invention.

FIG. 2 shows an alternative embodiment of the invention. The aerosol dispenser system 211 similarly comprises a nozzle 212, feeder pipe 213 and body 214. However, plunger channel 215 is made up from body 214 and wall 225, which is part of spacer collar 217, and which are joined together at joint 226. In this embodiment, shoulder 216 is integral with spacer collar 217, which is likewise joined by a screw thread (not shown) as joint 219 to container 220.

Figure 3:
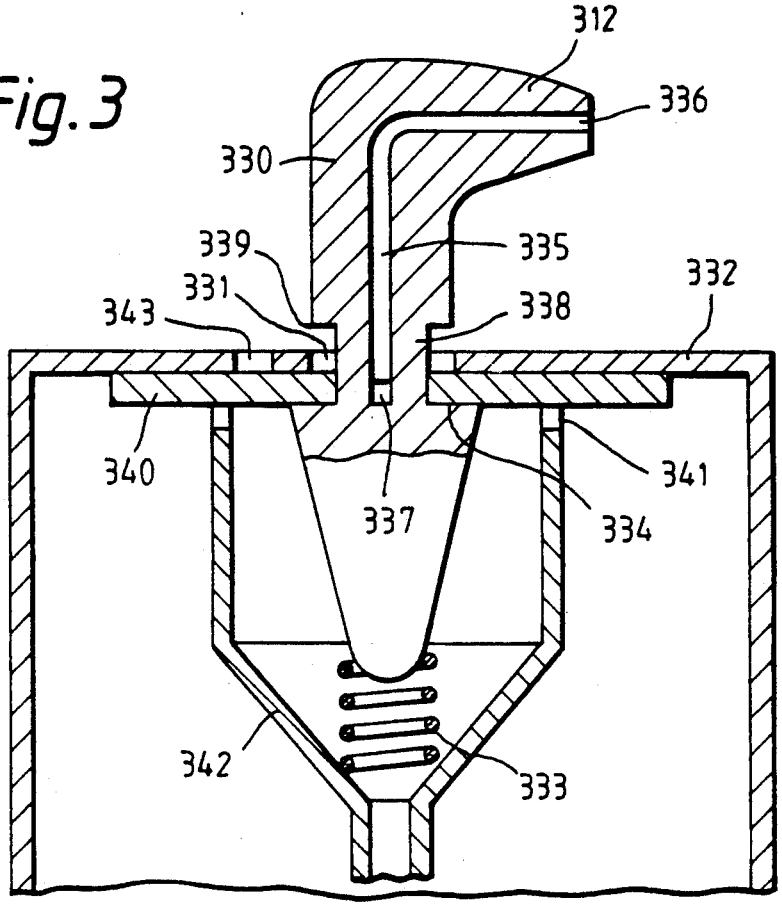
FIGS. 3 and 4 show cross sectional views of a preferred spray means according to the invention.
Figure 4:
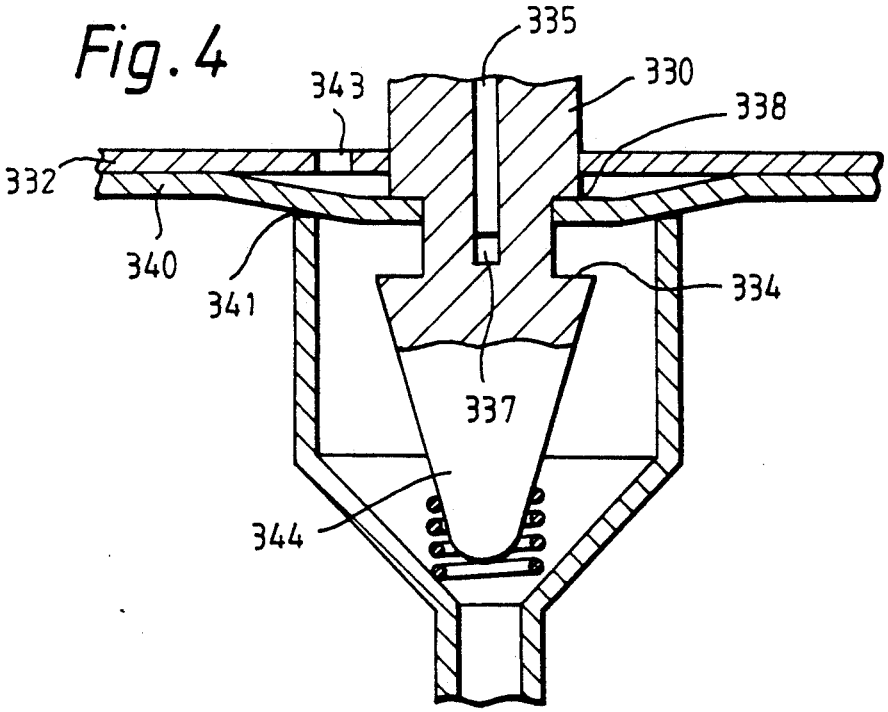

FIGS. 3 and 4 show in more detail the aerosol dispensing mechanism 12 which comprises the spray mechanism, and can be used in the embodiment of FIGS. 1 and 2.

In this embodiment of aerosol dispensing mechanism, the nozzle 312 is part of an integral body 330 which can be moved up and down in the opening 331 of a cover 332. Body 330 is displaced upwards by spring 333, with a shoulder 334 limiting the upwards displacement of body 330 which can occur under the influence of the spring. Body 330 (which also acts as an activator) has a passage 335, which at one end terminates in a spray nozzle 336, and at the other end joins a transverse bore 337 opening just above shoulder 334, in the lateral wall of constriction 338. Constriction 338 is at the other side delimited by shoulder 339.

Between shoulders 334 and 339 a valve disc 340 is present which, in the position shown in FIG. 3, is pressed against the upper internal wall of the cover 332, and then the connection between the passage 335 through the transverse bore 337 to the interior of the aerosol dispensing mechanism is interrupted. The disc 340 extends through an opening 341 in the wall of mixing chamber 342, the opening being sufficiently large for providing, between its edge and the disc 340, an air passage. Mixing chamber 342 is connected to the internal wall of the aerosol dispensing mechanism by a mechanism of supports not shown.

An aperture 343 is present in upper wall 332 of the aerosol dispensing mechanism, which is kept closed as a result of internal pressure in the aerosol dispensing mechanism. The aperture 343 can be supplied by pressure of air to generate a positive air from externally to generate a positive air pressure within the aerosol dispensing mechanism. At a sufficient level of external pressure, disc 340 is pressed away, and supplied air flows into the aerosol dispensing mechanism.

FIG. 4 shows the configuration of the aerosol dispensing mechanism where nozzle 312 is pressed downwards. Body 330 is pressed downwards in respect of disc 340, until the shoulder 338 contacts disc 340. Transverse bore 337 is then able to communicate with the air chamber, so that an air/liquid mixture can flow from the mixing chamber 342 towards the passage 335. At this time valve disc 340 is pressed against the rim of opening 341, and will operate generally as a valve. If there is sufficient internal pressure in the aerosol dispensing mechanism, air can flow towards the interior of the mixing chamber as it will press disc 340 a little upwards. The lower part 344 of body 330 is shaped in such a manner that, together with the wall of chamber 342, a whirling chamber is defined which is adapted to provide an optimal mixing effect.

Figure 5:
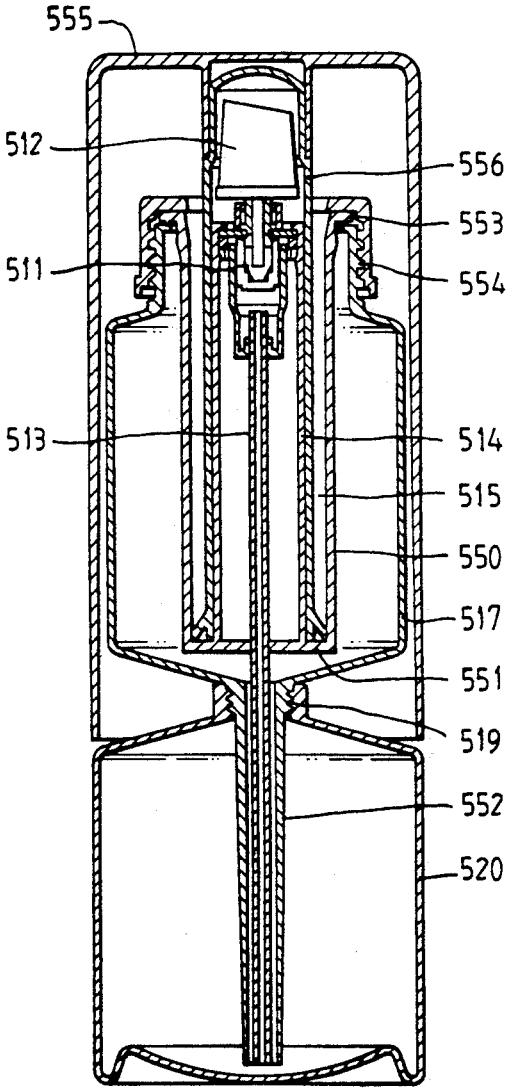
FIGS. 5 and 6 show cross sectional views of a further embodiment according to the invention.
Figure 6:
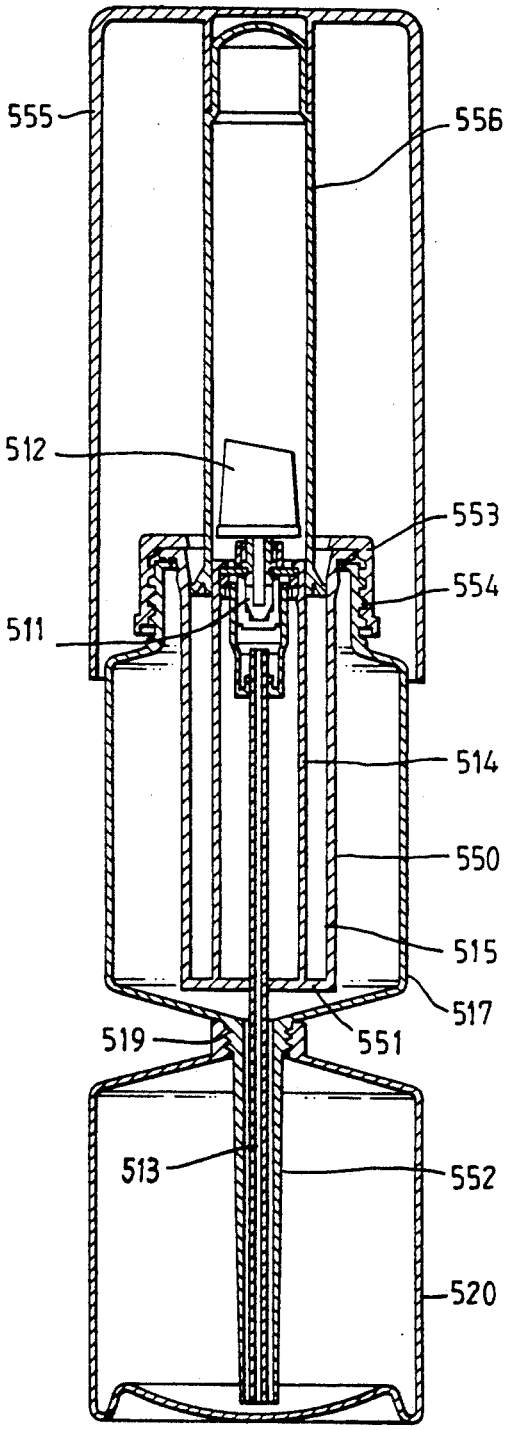

FIGS. 5 and 6 show cross sectional views of an alternative embodiment of the invention.

The apparatus comprises an aerosol dispenser mechanism 511, generally of the type described in relation to FIGS. 3 and 4. The aerosol dispenser mechanism 511 has a dispensing nozzle 512, and a feeder pipe 513 emanating from it. The mechanism also has a body portion 514, which along with wall portion 550 and end wall 551 define a tubular plunger channel 515. Such an aerosol dispensing mechanism may conveniently be purchased as a single unit.

The apparatus additionally has an intermediate spacer collar piece 517, manufactured from rigid plastics materials. This intermediate spacer collar 517 is shaped so as to enshroud the aerosol dispensing mechanism. The intermediate spacer collar 517 also attaches to a container 520 via a screw thread 519 to provide an airtight seal between the two. Container 520 is detachable, and in use contains the fluid to be dispensed (not shown). When container 520 is empty, it may be detached and refilled, but more conveniently it may simply be replaced by a further container which is pre-dosed with a volume of fluid.

Feeder pipe 513, which emanates from the aerosol dispensing mechanism, runs into container 520 and is used for supplying fluid from the container 520 to the aerosol dispensing mechanism. Feeder pipe 513 is further directed into container 520 by a guide tube 552, which is integrally moulded with intermediate spacer collar 517.

As previously mentioned, the aerosol dispensing mechanism can conveniently be obtained as a single unit. For this embodiment it is held in place in the intermediate spacer collar 517 by a threaded collar 553, which co-operates with a screw thread 554 which is integrally molded into intermediate spacer collar 517.

The apparatus of this embodiment also has a cap 555, in which is located a plunger 556. In use the apparatus maybe pressurized by the movement up and down of the cap, between the positions shown in FIGS. 5 and 6. This relative movement causes the plunger 556 to move up and down in plunger channel 515. With an aerosol dispensing mechanism as described for example in relation to FIGS. 3 and 4, air is caused to be admitted into the device via a one way valve in the aerosol dispensing mechanism (not shown). This causes a positive pressure to be developed in the intermediate spacer collar 517/container 520, which with the aerosol dispensing unit in place is otherwise an airtight unit. The manual movement of the cap up and down a number of times will generate a sufficient pressure in the apparatus for spraying of fluid to occur.

To use the device, the cap with plunger is removed, and nozzle 512 depressed. Fluid will be dispensed as an aerosol until the pressure inside the apparatus drops to a level such that the aerosol dispensing mechanism will no longer function. The apparatus can be repressurized by replacing the cap as shown in FIG. 5, and repeating the pressurization procedure.

We claim:

1. An aerosol dispensing apparatus for dispensing a liquid under pressure as an aerosol without the use of a pre-dosed propellant, comprising:

(i) a container for storing said liquid to be dispensed;

(ii) a means for introducing atmospheric air into said apparatus which comprises:

an elongated cylindrical body;

a cylindrical chamber having first and second ends and being within said body;

an elongated channel separating said body from said chamber; and a hollow plunger with an open end, said plunger fitting movably within said channel between said body and chamber;

(iii) a spray nozzle through which said liquid is to be dispensed, said nozzle being positioned within said hollow plunger;

(iv) a feeder pipe to supply said nozzle with the liquid to be dispensed; and (v) an intermediate spacer collar supporting said body, said chamber and said spray nozzle being detachably joined to said container and wherein said chamber is substantially surrounded along a length thereof by said spacer collar.

2. An apparatus according to claim 1, wherein said feed pipe is at least partially inside of said cylindrical chamber.

3. An apparatus according to claim 1, wherein said spacer collar is funnel-shaped at a bottom end thereof opposite from an end holding said nozzle.

4. An apparatus according to claim 1, wherein said spacer collar is detachably joined to said container via a threaded coupling, said coupling having a diameter smaller than a diameter of said elongated cylindrical body.

5. An apparatus according to claim 1, wherein said intermediate spacer collar and said container are made of molded plastics materials.

* * * * *